US009025798B2

(12) United States Patent
Saint Vincent et al.

(10) Patent No.: US 9,025,798 B2
(45) Date of Patent: May 5, 2015

(54) MULTI-COAXIAL TRANSDUCERS AND METHODS

(76) Inventors: Stephen Saint Vincent, New Braunfels, TX (US); Dai Zo Lee, Anaheim (CA); Pablo Co Tobiano, Pasig (PH)

( * ) Notice: Subject to any disclaimer, the term of this patent is extended or adjusted under 35 U.S.C. 154(b) by 46 days.

(21) Appl. No.: 13/703,266

(22) PCT Filed: Jun. 9, 2011

(86) PCT No.: PCT/US2011/039811

§ 371 (c)(1),
(2), (4) Date: Mar. 20, 2013

(87) PCT Pub. No.: WO2011/156608

PCT Pub. Date: Dec. 15, 2011

(65) Prior Publication Data

US 2013/0170675 A1 Jul. 4, 2013

Related U.S. Application Data

(60) Provisional application No. 61/353,205, filed on Jun. 9, 2010.

(51) Int. Cl.

| | |
|---|---|
| ***H04R 25/00*** | (2006.01) |
| ***H04R 1/24*** | (2006.01) |
| ***H04R 3/00*** | (2006.01) |

(52) U.S. Cl.
CPC ... *H04R 3/00* (2013.01); *H04R 1/24* (2013.01)

(58) Field of Classification Search
USPC ..... 381/182, 401–402, 421–422, 396
See application file for complete search history.

(56) References Cited

U.S. PATENT DOCUMENTS

| | | | | |
|---|---|---|---|---|
| 2,341,275 | A | 2/1944 | Holland | 381/152 |
| 3,609,253 | A | 9/1971 | Ashworth | 381/152 |
| 3,728,497 | A | 4/1973 | Komatsu | 381/392 |
| 4,297,537 | A | 10/1981 | Babb | 381/189 |
| 4,552,242 | A * | 11/1985 | Kashiwabara | 381/182 |
| 4,593,404 | A | 6/1986 | Bolin | 381/82 |
| 4,914,750 | A | 4/1990 | Lawson | 381/152 |
| 4,926,486 | A | 5/1990 | Barsumian | 381/152 |
| 4,951,270 | A | 8/1990 | Andrews | 367/140 |
| 5,058,173 | A | 10/1991 | Ashworth | 381/152 |
| 5,335,284 | A | 8/1994 | Lemons | 381/152 |
| 5,335,287 | A | 8/1994 | Athanas | 381/415 |
| 5,434,458 | A | 7/1995 | Stuart et al. | 310/13 |
| 5,473,700 | A | 12/1995 | Fenner | 381/336 |
| 5,546,469 | A | 8/1996 | Donahoe | 381/152 |
| 5,706,358 | A | 1/1998 | Ashworth | 381/152 |
| 6,031,925 | A | 2/2000 | Shteyn | 381/401 |
| 6,151,402 | A | 11/2000 | Azima et al. | 381/396 |
| 6,373,362 | B1 * | 4/2002 | Kim | 381/421 |

(Continued)

FOREIGN PATENT DOCUMENTS

KR 10-0394321 8/2003

OTHER PUBLICATIONS

International Search Report and Written Opinion issued in PCT/US2011/039811, dated Dec. 27, 2011.

(Continued)

*Primary Examiner* — Suhan Ni
(74) *Attorney, Agent, or Firm* — Norton Rose Fulbright US LLP

(57) ABSTRACT

Coaxial transducers, some of which include a first assembly and assembly, each of which includes a magnet and a coil.

12 Claims, 12 Drawing Sheets

(56) References Cited

U.S. PATENT DOCUMENTS

| | | | | |
|---|---|---|---|---|
| 6,519,349 | B1 | 2/2003 | Azima et al. | 381/396 |
| 6,618,487 | B1 | 9/2003 | Azima et al. | 381/152 |
| 6,741,721 | B2 * | 5/2004 | Fukawatase et al. | 381/421 |
| 6,751,333 | B1 | 6/2004 | Azima et al. | 381/396 |
| 6,963,650 | B2 * | 11/2005 | Combest | 381/182 |
| 6,965,679 | B1 | 11/2005 | Lopez Bosio et al. | 381/152 |
| 7,030,522 | B2 | 4/2006 | Nakajima et al. | 310/81 |
| 7,324,657 | B2 * | 1/2008 | Kobayashi et al. | 381/182 |
| 7,386,137 | B2 | 6/2008 | Combest | 381/182 |
| 7,386,144 | B2 | 6/2008 | Vincent et al. | 381/412 |
| 2002/0051557 | A1 | 5/2002 | Kobayashi et al. | 381/401 |
| 2004/0202342 | A1 | 10/2004 | Anthony et al. | 381/342 |
| 2007/0230737 | A1 | 10/2007 | Hyde | 381/421 |
| 2008/0205687 | A1 | 8/2008 | Vincent et al. | 381/400 |

OTHER PUBLICATIONS

International Preliminary Report on Patentability issued in PCT/US2011/039811, dated Dec. 20, 2012.

* cited by examiner

MULTI-COAXIAL TRANSDUCERS AND METHODS

CROSS-REFERENCE TO RELATED APPLICATIONS

This application is a national phase application under 35 U.S.C. §371 of International Application No. PCT/US2011/039811, filed Jun. 9, 2011, which claims priority U.S. Provisional Application No. 61/353,205, filed Jun. 9, 2010. The entire text of each of the above-referenced applications is specifically incorporated by reference without disclaimer.

BACKGROUND OF THE INVENTION

1. Field of the Invention

The present invention relates generally to inertial type transducers capable of converting energy between electrical and mechanical form and, more particularly, to inertial type transducers that utilize a plurality of co-axially aligned moving coils and methods of using such transducers.

2. Description of the Related Art

Inertial voice coil actuators may be used to acoustically stimulate semi-rigid structures to reproduce sound. Various types of electro-mechanical transducers may be attached to structures that are characterized by a relatively high mechanical input impedance, such as room partitions, ceilings, furniture, etc., and that then act as a soundboard when acoustically-stimulated to radiate sound. Efficient coupling between the electrical stimulus and sound output may be made with electro-mechanical transduction machinery that is designed to create high force for a given electrical input.

The electro-acoustic transducers (or systems) used for acoustic sound reproduction may include: solid state, solenoid, moving magnet and moving voice coil transducers.

Solid state transducers may use piezoceramic or magnetostrictive materials as their core. These materials exhibit physical shape change properties when exposed to an applied electric or magnetic field. These devices in acoustic applications are characterized by high mechanical output impedance but with very limited displacement. Their use is most common in high frequencies above 200 Hertz (Hz). Commercial use is typically limited by distortion related to the intrinsic material properties.

Solenoid transducers are generally not suitable for high fidelity sound reproduction applications. Some of the earliest attempts to commercialize inertial type acoustic transducers utilized solenoid type armatures within a fixed electromagnet. These systems are characterized by low frequency operation. High frequency operation is often limited by magnetic core saturation or eddy current distortion.

Moving magnet transducers, although capable of very high efficiency in narrow frequency ranges, have shown little commercial viability for full-frequency, high fidelity applications. They share similar physical constrains as those of solenoid transducers.

Most of the commercial attempts for sound reproduction have been based on the moving voice coil transducer architecture that may be used for conventional loudspeaker applications. These systems are characterized by relatively low force and high displacements.

As is well known in the art, the force generated by an electro-dynamic transducer is a product of the current, i, length of coil wire, L, and magnetic flux density, B, so that $F=iLB$. The length of the coil wire that is within the annular magnetic gap is defined as the length, L. This force is what creates the movement of the coil and subsequently generates sound.

These inertial type voice coil transducers are built upon magnetic circuit designs that have classically been used for conventional cone type loudspeakers and not optimized for driving soundboard type structures. These voice coil actuators often require the use of an external housing to support the heavy magnet assembly relative to the voice coil. The voice coil is in communication with the external housing at a location coincident with an acoustic output system that permits the transducer housing to be mechanically attached to a soundboard.

Prior loudspeaker motors include a magnet circuit assembly having a permanent annular magnet, polarized in the axial direction, and sandwiched between two magnetizable plates. One of the plates carries a cylindrical post that extends through a central space defined by the annular magnet, generally referred to as a cylindrical pole piece. The other plate has an annular opening, somewhat larger than the diameter of the pole piece, such that an annular magnetic gap is formed between the post and the inner edge of the associated annular plate. The height of the gap is formed by the thickness of the annular plate having the annular opening.

The basic architecture of the loudspeaker motor design is based upon low magnetic energy magnets, typically comprised of ceramic materials. In order for sufficient magnetic flux to be generated within the annular magnetic gap, the annular magnet must be very large relative to the other components. Some manufacturers have utilized higher energy rare earth based magnets such as Neodymium, but this magnetic architecture is not optimized for the characteristics of these magnets.

Voice coil actuators have a moveable voice coil disposed within the annular magnetic gap. For speakers that use a large body such as a wall to generate sound, the coil has a suspension system that typically utilizes an external housing to which the annular magnet and magnetizable plates are also attached. The external housing provides radial stiffness and axial compliance to the coil. The moving coil has a first end fixedly secured to a radially central portion of the inner surface of the external housing wall. A mounting screw secured to an exterior well portion of the exterior housing may be attached to the wall.

Patents that disclose some of the aforementioned factors include U.S. Pat. No. 2,341,275; U.S. Pat. No. 3,609,253; U.S. Pat. No. 3,728,497; U.S. Pat. No. 4,297,537; U.S. Pat. No. 4,951,270; U.S. Pat. No. 5,335,284; and U.S. Pat. No. 5,473,700.

In practice, the annular magnet, magnetizable plates, external housing and structural attachment point comprise a system that is large and heavy relative to the total dynamic force the actuator is capable of generating. If the external housing is mounted on a vertical facing surface, e.g., a wall, large bending moments are placed on the structural attachment point and the housing must accommodate these moments without translating them to the coil.

U.S. Pat. No. 6,618,487 describes an electro-dynamic inertial exciter that is characterized by a magnetic circuit, which is mechanically clipped to a carrier assembly, which integrates an annular voice coil carrier and an axially compliant suspension. The voice coil carrier and suspension may be formed from co-molded plastics.

U.S. Pat. No. 7,386,137 describes an electro-dynamic inertial exciter that is characterized by a symmetric dual motor concept, wherein two magnetic circuits are symmetric about a mirror plane. Interposed between the two magnetic circuits is a common voice coil former coupled to an elongated shaft. The elongated shaft rides on friction bearings, while providing radial alignment of the voice coils within their respective air gaps.

U.S. Pat. No. 7,386,144 describes a momentum type transducer that utilizes a single voice coil operating in an air gap with radially polarized magnets. The magnetic circuit is aligned with the moving voice coil via a plurality of suspension elements between the magnetic circuit and the moving voice coil.

SUMMARY OF THE INVENTION

Transducers are claimed. In some embodiments, the transducer may include a first assembly and a second assembly. In some embodiments, the first assembly may include a first magnet operatively associated with a first coil. The first coil may define a first perimeter. In some embodiments, the first assembly may also include a first flux focuser configured to shape the magnetic flux of the first magnet. In some embodiments, the second assembly may also include a second magnet operatively associated with a second coil. The second coil may be substantially coaxial with the first coil and may also be bounded by the perimeter of the first coil. The second assembly may also include a second flux focuser configured to shape the magnetic flux of the second magnet. In some embodiments, the first assembly may be coupled to the second assembly.

In some embodiments, the transducer may further include N assemblies, where N is greater than or equal to 3. The Nth assembly may include an Nth magnet operatively associated with an Nth coil. The Nth coil may be substantially coaxial with the (Nth−1) coil and may also be bounded by the perimeter of the (Nth−1) coil. The Nth assembly may also include an Nth flux focuser configured to shape the magnetic flux of the Nth magnet.

In some embodiments, the transducer may also include a first coil former coupled to the first coil. The transducer may also include a second coil former coupled to the second coil.

In some embodiments of the transducer, at least one of the first coil former and the second coil former may include one or more ventilation holes.

In some embodiments of the transducer, at least one of the first coil former and the second coil former includes one or more slits configured to limit eddy current formation.

In some embodiments, the first flux focuser may include a first magnetic circuit return path attached to the first magnet. In some embodiments, the transducer may also include a first plate attached to the first magnet. In some embodiments, the transducer may also include a first bucking magnet attached to the first plate.

In some embodiments, the second flux focuser may include a second magnetic circuit return path attached to the first magnet. In some embodiments, the transducer may also include a second plate attached to the second magnet. In some embodiments, the transducer may also include a second bucking magnet attached to the second plate.

In some embodiments, the transducer may include an external housing. The external housing may be coupled to the first assembly by one or more suspension elements. In some embodiments, the one or more suspension elements may include springs. In some embodiments, the external housing may include an output base to which the first coil former and the second coil former are attached. In some embodiments, the external housing may also include a top that is coupled to the output base and to the first assembly by the one or more suspension elements.

In some embodiments, the external housing includes a positive electric terminal and a negative electric terminal. The positive and negative electric terminals may be configured to connect to an external signal source. The positive and negative electrical terminals may also be coupled to the first coil and the second coil. In some embodiments, the positive and negative electrical terminals are coupled to the first coil and the second coil in a parallel configuration.

In some embodiments, the transducer may be configured to be a heat transfer surface.

In some embodiments, the transducer may comprise two coaxially-arranged assemblies that are coupled together, each assembly including a magnet and a coil, where one assembly at least partially overlaps the other assembly; and a housing to which one of the assemblies is coupled through at least one suspension element.

In some embodiments, the transducer may comprise a housing; a first magnet positioned inside the housing; a first coil positioned around at least a portion of the first magnet, the first coil being coupled to the housing, the first coil having a first outer perimeter; a second magnet coupled to the first magnet; and a second coil positioned around at least a portion of the second magnet, the second coil being coupled to the housing in substantially coaxial alignment with the first coil and having a second outer perimeter that is less than the first outer perimeter. The first magnet may be coupled to the housing and to the second magnet such that the first and second magnets are capable of moving together.

In some embodiments, the transducer may comprise a housing; a first magnet positioned inside the housing; a first coil positioned around at least a portion of the first magnet, the first coil being coupled to the housing, the first coil having an outer perimeter; a second magnet coupled to the first magnet; and a second coil positioned around at least a portion of the second magnet, the second coil being coupled to the housing in substantially coaxial alignment with the first coil and having a second outer perimeter that is less than the first outer perimeter. The first magnet may be coupled to the housing and to the second magnet such that the first and second magnets are capable of moving relative to the first and second coils.

Some embodiments of the present methods include coupling a transducer having coaxial coils of different perimeters (e.g., diameters) to a semi-rigid structure. Some embodiments also include using the transducer to cause the semi-rigid structure to produce sound.

The term "coupled" is defined as connected, although not necessarily directly, and not necessarily mechanically.

The terms "a" and "an" are defined as one or more unless this disclosure explicitly requires otherwise.

The term "substantially" is defined as being largely but not necessarily wholly what is specified as understood by a person of ordinary skill in the art. For example, in any of the present embodiments in which the term "substantially" is used, the term "substantially" may be substituted with "within [a percentage] of" what is specified, where the percentage includes any of 0.5, 1, 5, and/or 10 percent.

The terms "comprise" (and any form of comprise, such as "comprises" and "comprising"), "have" (and any form of have, such as "has" and "having"), and "include" (and any form of include, such as "includes" and "including") are open-ended linking verbs. As a result, a device or method that "comprises," "has" or "includes" one or more elements or steps possesses those one or more steps or elements, but is not limited to possessing only those one or more elements. Likewise, a step of a method or an element of a device that "comprises," "has" or "includes" one or more features possesses those one or more features, but is not limited to possessing only those one or more features. Furthermore, a device or structure that is configured in a certain way is configured in at least that way, but may also be configured in ways that are not listed.

BRIEF DESCRIPTION OF THE DRAWINGS

The following drawings illustrate by way of example and not limitation. For the sake of brevity and clarity, every feature of a given structure is not always labeled in every figure in which that structure appears. Identical reference numbers do not necessarily indicate an identical structure. Rather, the same reference number may be used to indicate a similar feature or a feature with similar functionality, as may non-identical reference numbers.

DETAILED DESCRIPTION

Figure 1A:
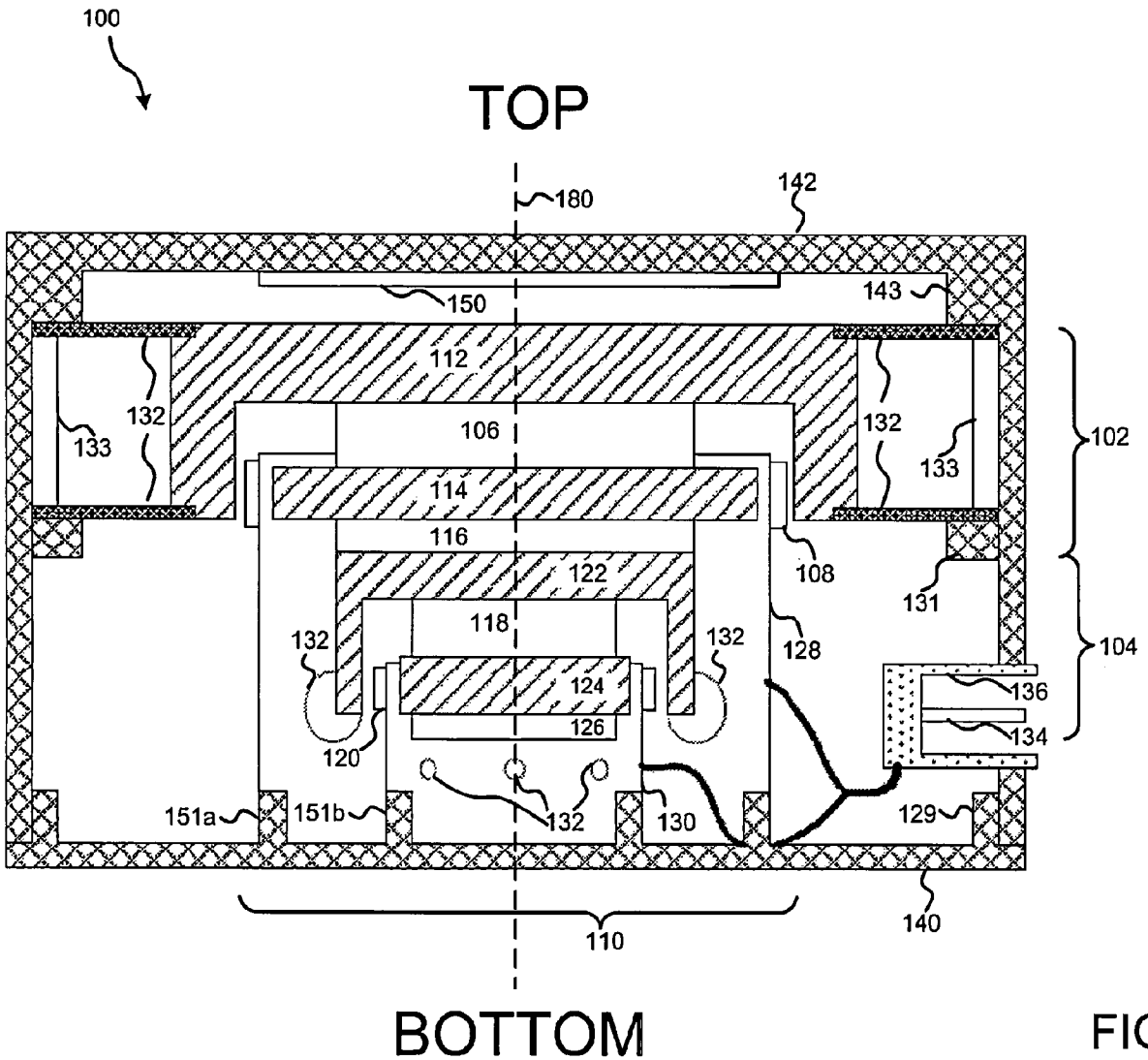
FIG. 1A illustrates in cross-section one embodiment of the present transducers.
Figure 1B:
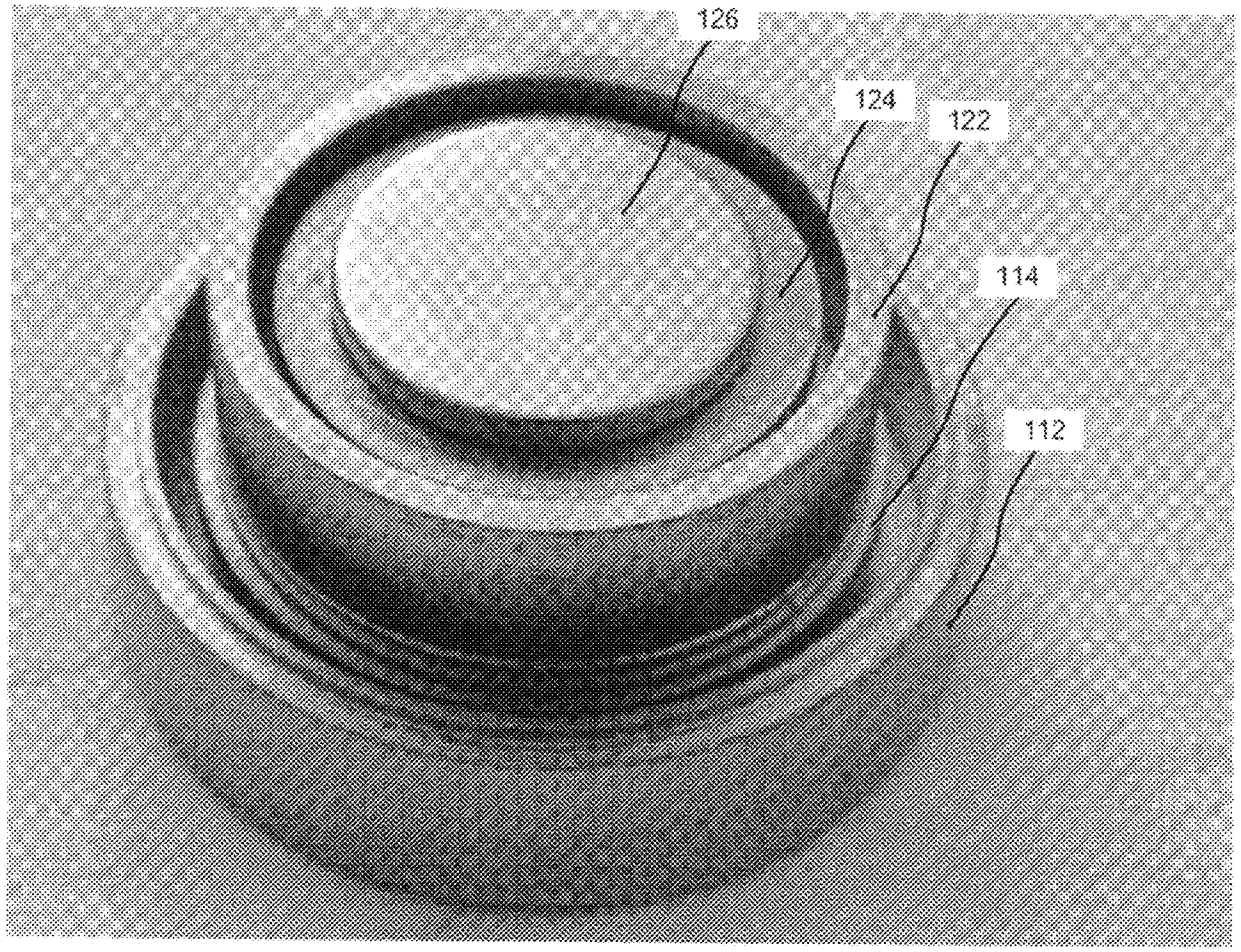
FIGS. 1B-1E are photographs of components of an actual version of one of the present transducers.
Figure 1C:
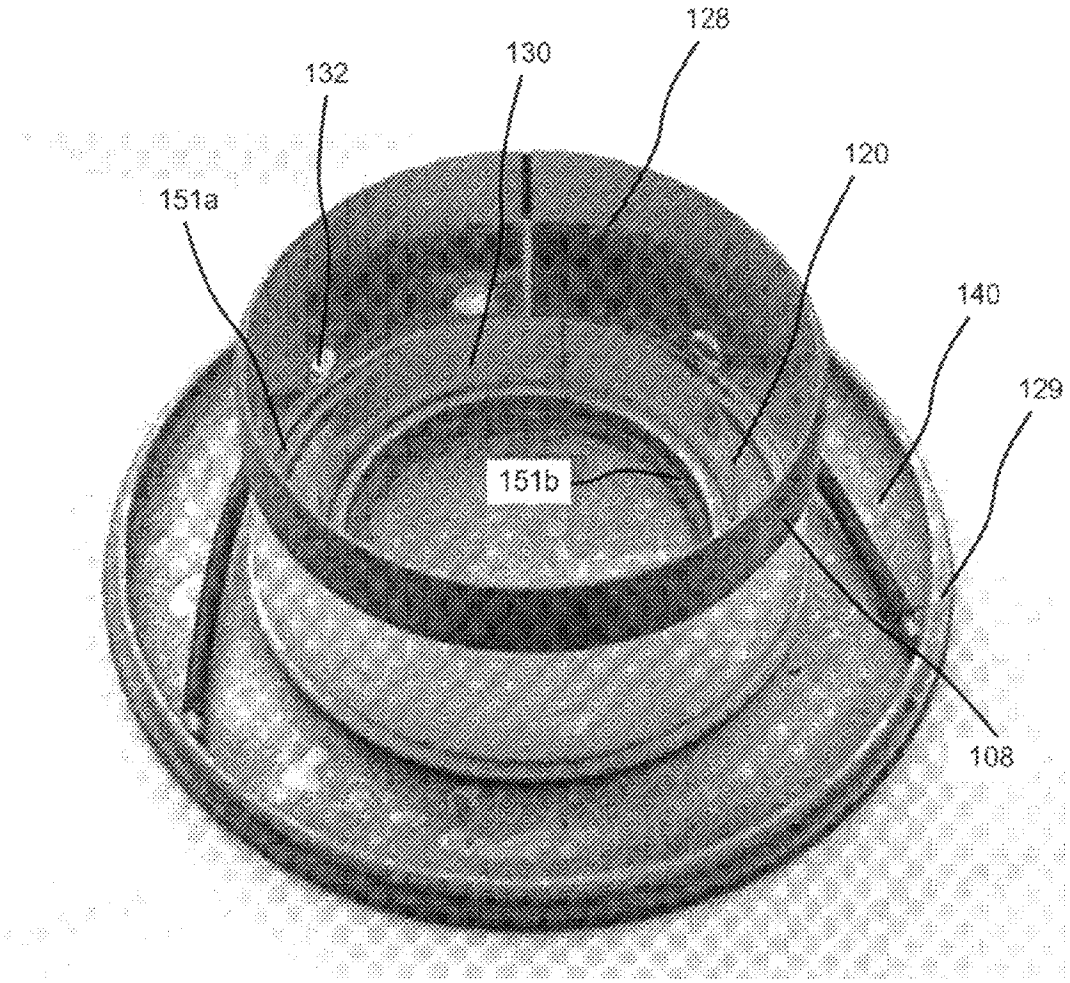
Figure 1D:
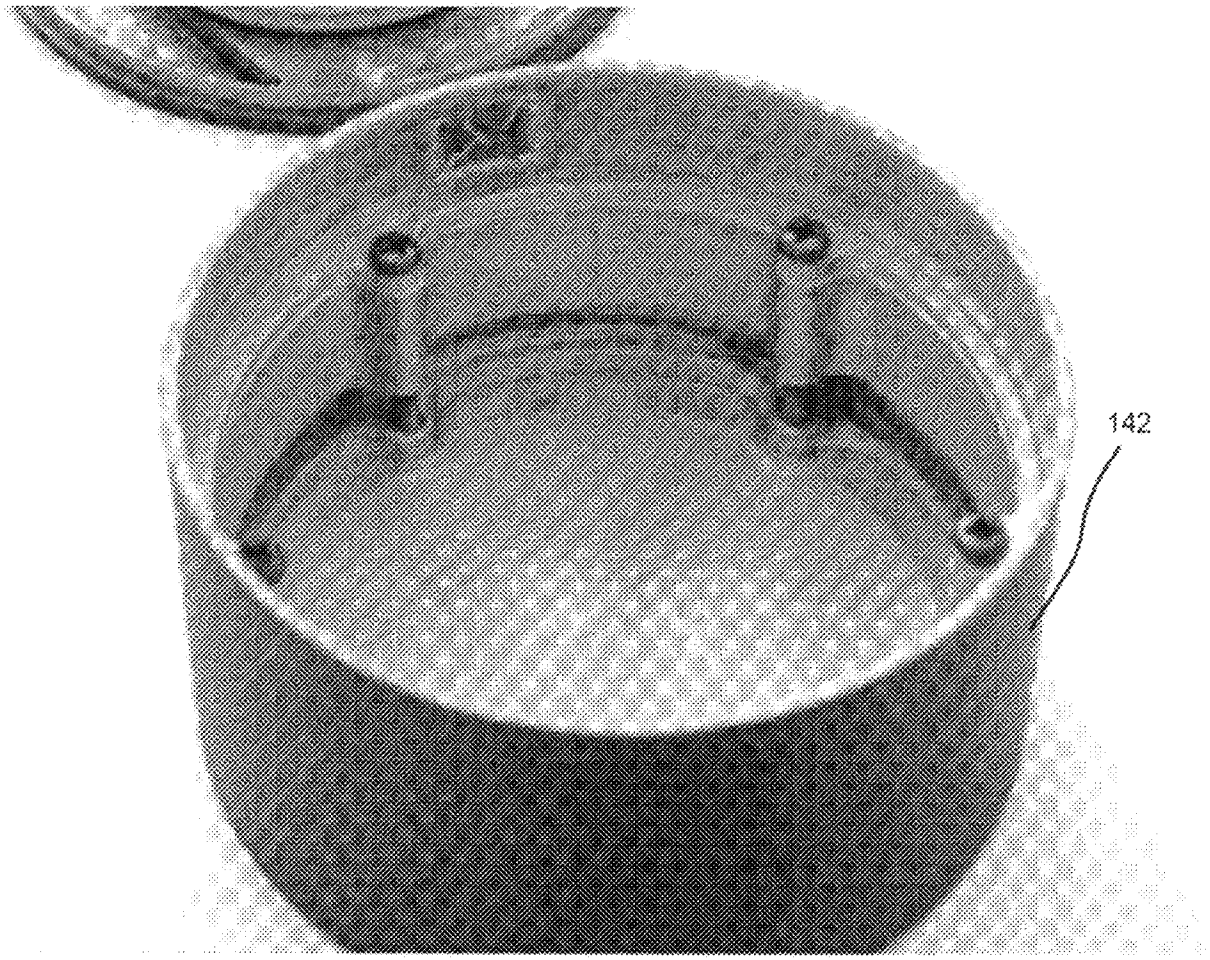
Figure 1E:
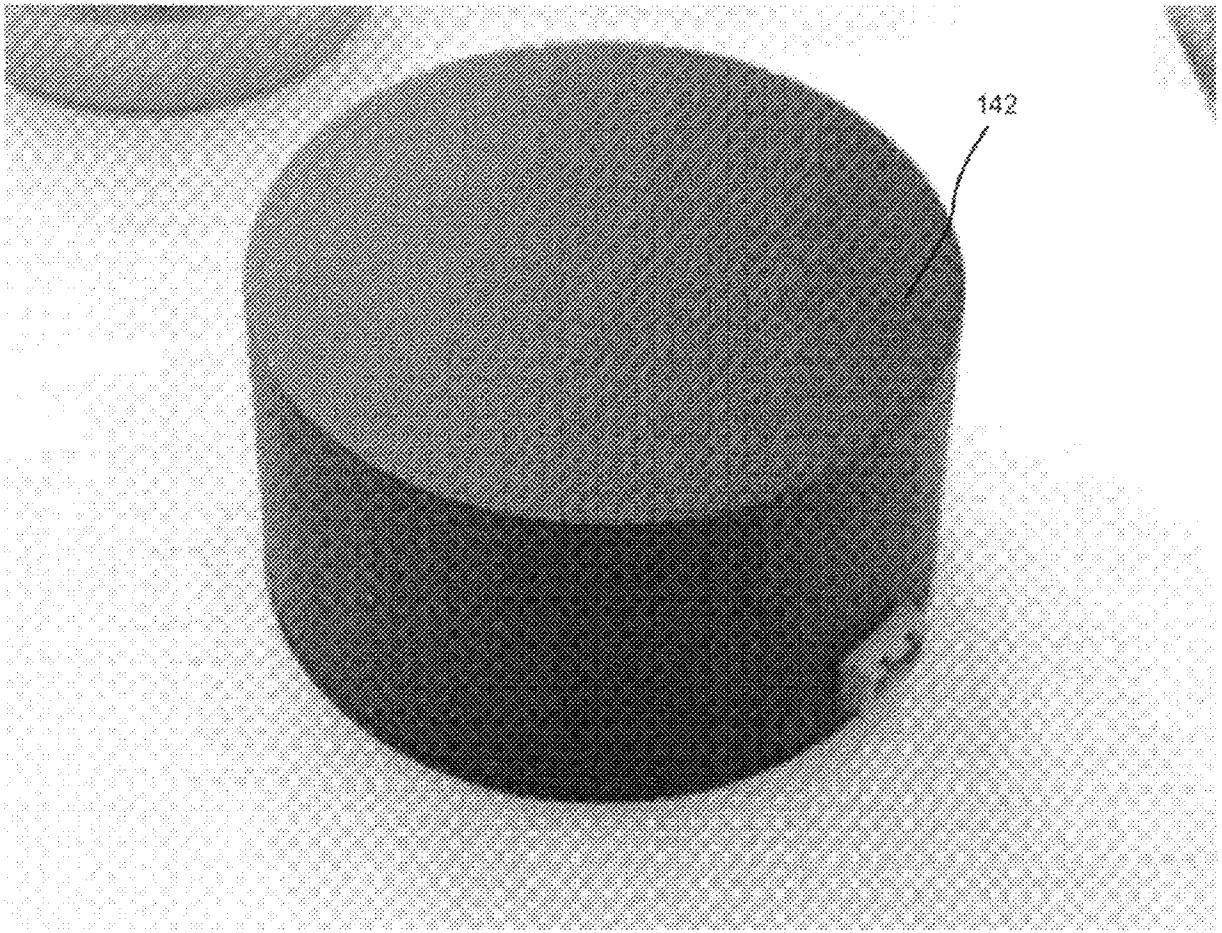

FIG. 1A depicts a cross section of transducer 100, one embodiment of the present transducers (which may be characterized as coaxial transducers), taken along its diameter. Transducer 100 may also be referred to by those having skill in the art as an inertial voice coil actuator or an inertial type acoustic exciter. In some embodiments, transducer 100 may also be referred to as a multi-coaxial momentum type transducer. Transducer 100 is configured to receive an electrical power signal from a source such as a power amplifier. Transducer 100 will respond to an incoming electrical signal by converting or transducing that signal to a corresponding mechanical force and displacement.

Embodiments of the present transducers may be coupled to a structure and cause that structure to produce sound when the transducer moves in response to the signal conversion/transduction. The structure may be an acoustic structure that exhibits frequency-dependent bending wave propagation speeds, and the mechanical force and displacement the transducer produces may be imparted to the structure. Such structures include, but are not limited to, walls, ceilings, and panes of glass; more specific non-limiting examples include a gypsum or wood-paneled architectural system such as a wall and/or a ceiling, composite panel systems including structural skins with or without core, and glass panels. Embodiments of the present methods include coupling (e.g., through direct attachment) one of the present transducers to a structure (such as a wall, ceiling, or pane of glass, to name a few), and causing the structure to produce (or output) sound when the coils of the transducer receive an audio signal.

Some embodiments of the present transducers may be cylindrically-shaped. Transducer 100 is one such example. In FIG. 1A, the top and bottom of transducer 100 are labeled. These labels—as well as references to top and bottom herein—are merely included for the convenience of this disclosure. In different embodiments, transducer 100 may be flipped, reversed, or otherwise used with any directionality.

Transducer 100 includes first assembly 102 and second assembly 104. In some embodiments, first assembly 102 and second assembly 104 are coupled together, as they are in the depicted embodiment. Specifically, first assembly 102 is directly coupled to second assembly 104 through the connection between the bucking magnet of the first assembly (discussed below) and the magnetic circuit return path of the second assembly (discussed below). In other embodiment, the two assemblies may be indirectly coupled by using intervening plates, and/or additional magnets between first assembly 102 and second assembly 104. First assembly 102 and second assembly 104 are coaxially aligned.

First assembly 102 includes first magnet 106. In some embodiments, first magnet 106 is a cylindrical magnet. In some embodiments, first magnet 106 is a neodymium magnet. In some embodiments, the south polarity of first magnet 106 may be on its top side, and in those embodiments, the north polarity of the first magnet 106 may be on its bottom side. In other embodiments, these polarities may be reversed.

In some embodiments, first assembly 102 also includes first coil 108, which is operatively associated with first magnet 106. In the depicted embodiment, first coil 108 is coaxially aligned with first magnet 106. First coil 108 may also be referred to as a voice coil. First coil 108 may be electrically conductive. First coil 108 may be formed from copper, aluminum, silver wire or other like materials. First coil 108 defines a perimeter 110, which may also be characterized as a first outer perimeter. In the depicted embodiment, first coil 108 is not in contact with first magnet 106. First coil 108 is positioned around first magnet 106.

In some embodiments, as in the depicted embodiment, first assembly 102 may also include a first flux focuser configured to shape the magnetic flux of first magnet 106. The first flux focuser may shape the magnetic flux of first magnet 106 and focus the magnetic flux toward first coil 108. In the embodiment depicted in FIG. 1A, the first flux focuser includes first magnetic circuit return path 112, first plate 114, and first bucking magnet 116.

In some embodiments, first magnetic circuit return path 112—which may also be referred to as the magnetic reluctance return path—may include conduction elements within first assembly 102 that provide a low reluctance path for the magnetic flux associated with first magnet 106. First magnetic circuit return path 112 may include materials with high magnetic saturation flux density and high magnetic permeability. For example, in some embodiments, first magnetic circuit return path 112 may have a magnetic saturation flux density greater than 2 Tesla. The first magnetic circuit return path 112 may comprise a low carbon steel or a high performance magnetic alloy, such as permendur. In some embodiments, and as shown in FIG. 1A, first magnetic circuit return path 112 may be cup-shaped. In FIG. 1A, the "open-side" of the cup shape of first magnetic circuit return path 112 is facing the bottom of transducer 100 and is (directly) attached to the top of first magnet 106. First magnetic circuit return path 112 may also be indirectly attached to first magnet 106 through, for example, one or more intervening plates and/or one or more additional magnets.

In some embodiments, as in the depicted embodiment, first magnetic circuit return path 112 at least partially surrounds (or bounds) first coil 108. Moreover, in some embodiments, as in the depicted embodiment, first coil 108 is located at least partially in the "air-gap" created between first magnet 106 and first magnetic circuit return path 112.

First assembly 102 also includes first plate 114, which is (directly) attached to first magnet 106. More specifically, first plate 114 is attached to the bottom of first magnet 106, or to the side of first magnet 106 opposite the side to which first magnetic circuit return path 112 is attached. In some embodiments, first plate 114 may be indirectly attached to first magnet 106, such as by using one or more intervening plates and/or one or more additional magnets. First plate 114 may comprise a magnetic material or materials, such as a low-carbon steel or a high-performance magnetic alloy, such as permendur. In some embodiments, first plate 114 concentrates the magnetic flux from first magnet 106 and first bucking magnet 116 (discussed below) within the air-gap created between first magnet 106 and first magnetic circuit return path 112. As a result, first plate 114 may be characterized as configured to concentrate the magnetic flux from first magnet 106 and first bucking magnet 116 within the air-gap created between first magnet 106 and first magnetic circuit return path 112.

First assembly 102 also includes first bucking magnet 116, which, in the depicted embodiment, has a circular perimeter and is (directly) attached to first plate 114 on the side opposite the side of the first plate to which first magnet 106 is attached. In some embodiments, first bucking magnet 116 concentrates the magnetic flux within the air-gap created between first magnet 106 and first magnetic circuit return path 112. As a result, first bucking magnet 116 may be characterized as configured to concentrate the magnetic flux within the air-gap created between first magnet 106 and first magnetic circuit return path 112. First bucking magnet 116 may prevent magnetic flux leakage from first assembly 102. In some embodiments, the polarity of first bucking magnet 116 is opposed to the polarity of first magnet 106. For example, in embodiments where the south polarity is at the top side of the first magnet 106, the south polarity of first bucking magnet 116 may be at its bottom side. Similarly, where the north polarity is at the bottom side of first magnet 106, the north polarity of first bucking magnet 116 may be at its top side.

Second assembly 104 includes second magnet 118 and second coil 120 that are operatively associated with each other. Second coil 120 may be (and is, in the depicted embodiment) substantially coaxial with first coil 108 and bounded by perimeter 110 of first coil 108. Second coil 120 has an outer perimeter (not labeled) that is less than perimeter 110 of first coil 108. Second assembly 104 is configured similarly to first assembly 102, but in some embodiments, as in the depicted embodiment, the respective diameters of the components in second assembly 104 are smaller than the respective diameters of the components in first assembly 102. Second assembly 106 includes a second flux focuser configured to shape the magnetic flux of second magnet 118. The second flux focuser includes second magnetic circuit return path 122, second plate 124, and second bucking magnet 126. In some embodiments, the components of second assembly 104 may comprise material(s) that are similar to those from which the first assembly components may be comprised. However, in other embodiments, the same respective components of the assemblies could be made from a different material or materials.

As FIG. 1A shows, transducer 100 (and, more specifically, first assembly 102) may also include first coil former 128 coupled to first coil 108. Transducer 100 (and, more specifically, second assembly 104) also includes second coil former 130 coupled to second coil 120. Specifically, first coil 108 and second coil 120 may be wrapped around first coil former 128 and second coil former 130, respectively. As a result, the shape of the coils approximates the shape of the formers around which they are respectively wrapped. First assembly 102 may be characterized as at least partially overlapping second assembly 104, given the position of first coil former 128 to second coil former 130.

First coil former 128 and second coil former 130 may comprise a material or materials that have high heat conduction capacity. In some embodiments, first coil former 128 and second coil former 130 are made from an electrically-conductive material. For example, in some embodiments, aluminum may be used. In some embodiments, first coil former 128 and second coil former 130 have a substantially cylindrical form, but do not have a continuous form. In such embodiments, first coil former 128 and second coil former 130 include a slit (not shown) configured in a substantially axial direction to prevent the formation of eddy currents. First coil former 128 and second coil former 130 may include one or more ventilation holes 132 to permit pressure equalization between the internal volume between first coil former 128 and second coil former 130 and the environment external to first coil former 128. These ventilation holes may also lower the first resonant frequency of the transducer. Ventilation holes 132 may be referred to as "huffing" holes.

In some embodiments, transducer 100 includes a housing, which may be characterized in some embodiments as an external housing. In some embodiments, an in the depicted embodiment, the external housing includes an output base 140 to which first coil former 128 and second coil 130 former are (directly) attached. In some embodiments, output base 140 includes radial rings 151*a* and 151*b* for aligning first coil former 128 and second coil former 130. More specifically, first coil former 128 is attached to radial ring 151*a*, and second coil former is attached to radial ring 151*b*. As discussed earlier, output base 140 may be coupled with an acoustic structure. In some embodiments, the external housing may also include top 142, which is coupled to output base 140. In some embodiments, top 142 is coupled to output base 140 by radial ring 129. The external housing may optionally include a sealed cover in which discrete power amplification and/or power conditioning circuits (not shown) are housed.

In some embodiments, as in the depicted embodiment, top 142 may be further coupled to first assembly 102 by one or more suspension elements 139. These suspension elements may include springs. Some suspension elements 139 may be attached to shoulder 143 of top 142 and to first assembly 102 through the topside of first magnetic circuit return path 112. Other suspension elements 139 may be attached to first assembly through the bottom edge of magnetic circuit return path 112 and to top 142 through clamping flange 131. As shown in FIG. 1A, top and bottom suspension element 139 are also supported by spacer 133, which provides a clamping surface for suspension elements 139 and also separates (or creates a separation between) suspension elements 139. The position of clamping flange 131 relative to shoulder 143 of top 142 may compress suspension elements 139. Suspension elements 139 may comprise polypropylene, glass fiber-reinforced epoxy, and the like. Spacer 133 may comprise aluminum or plastic materials. Clamping flange 131 may comprise aluminum or plastic materials.

As shown in FIG. 1A, first magnet 106, second magnet 118, the first flux focuser, and the second flux focuser may be mechanically suspended to form a "suspension unit" that moves together relative to the first coil 108 and second coil 120. In some embodiments, movement of the suspension unit may be substantially frictionless. The suspension elements may help restore the suspension unit to a neutral position (which is the position shown in FIG. 1A) when the unit is axially displaced from that neutral position. The axial compliance of the suspension unit may be adjusted to set the unit's free resonance, $F_o$. Those adjustments may be made through the number of suspension elements used, the manner in which they are attached to the unit (e.g, through which component or components of the suspension unit), the configuration of the components of suspension unit, and the manner in which those components are coupled together. In some embodiments the $F_o$ of the suspension unit may by sufficiently low (nominally 40 Hz). The intrinsic Young's modulus of the suspension elements 139 may be configured to improve high frequency (greater than 5 kHz) output of the transducer.

Multiple suspension elements 139 may prevent potential tilting of the suspension unit within the external housing. It may also be possible, given the relative flexibility of the suspension elements, for the suspension unit to tilt with respect to one or both of the first and second coils; more rigid or even more suspension elements may help prevent this from happening. In embodiments with multiple suspension elements 139, the properties of each of the suspension elements 139 may be configured (e.g., optimized) independent of each other. As a result, one or more of the suspension elements that are used may have different properties from each other. Such optimization may enable increase power handling at resonance of the suspension unit, smoothed frequency response of transducer 100, and damping that at least tends to suppress resonant modes of the suspension unit. In embodiments with one suspension element 139, the suspension element 139 may be optimally positioned at or near the central plane of mass of the combined magnetic assemblies 102 and 104. As a result, the suspension unit will be unlikely to tilt (and may not tilt) when subjected to forces normal to a central axis 180.

The top 142 of external housing may also include displacement limiter 150, which acts as bumper to prevent first assembly 102 from striking top 142 of the external housing, such as during high excursion operation. Displacement limiter 150 may be comprised of a soft or semi-rigid material, such as foam and may also include a damping material, such as, but not limited to, a constrained layer damper.

In some embodiments, the external housing includes an electrical connector, which may include positive electric terminal 134 and negative electric terminal 136. Positive and negative electric terminals 134, 136 may be configured, as in the depicted embodiment, to connect to an external signal source. Positive and negative electrical terminals 134, 136 are coupled to first coil 108 and second coil 120 in a parallel configuration that is discussed in more detail with respect to FIGS. 2A and 2B. One suitable non-limiting example of an electrical connector that may be used with some embodiments of the present transducers (e.g., which may be used for terminals 134 and 136) is a pluggable Euro-style connector with 2 poles and a pin spacing of 0.200 inches (5.08 mm). Some embodiments of the present transducers may also include a cable configured to interface with the connector, such as a cable comprising 2-conductor speaker wire having a gauge ranging from 24-12 American Wire Gauge.

In some embodiments, the external housing may be configured to form a fire-rated black box such that the transducer is serviceable for plenum and other fire-rated applications. In some embodiments, the external housing may include non-combustible materials. In some embodiments, the external housing may be configured to be watertight, including the electrical connectors; thus, the transducer 100 may also be watertight. Those skilled in the art will recognize that some embodiments of the present transducers can be sealed in and connectable to an outside source through a non-combustible junction box with liquid tight electrical conductors, and that such a transducer may be compliant with at least some fire-rated applications.

In some embodiments, the transducer's external housing may also be configured to serve as a heat transfer surface. This may be accomplished by using aluminum for the external housing. As a result, heat generated by the direct current losses in first coil 108 and second coil 120 may be transferred through first coil former 128 and second coil former 130 to the external housing, and from the external housing to the environment. The housing may also comprise a lightweight material. Aluminum may serve this function, as may one or more high performance plastics.

The components of some embodiments of the present transducers may be assembled or otherwise connected to each other using high-performance adhesives that provide high structural strength, work at elevated temperatures, and provide a mechanical transmission path for acoustic energy. For example, epoxies, rubber toughened and temperature resistant cyanoacrylates, and other bonding agents may be used to bind the components within embodiments of the present transducers, such as transducer 100. FIGS. 1B-1E depict photographs of components of an actual version of transducer 100.

Figure 1F:
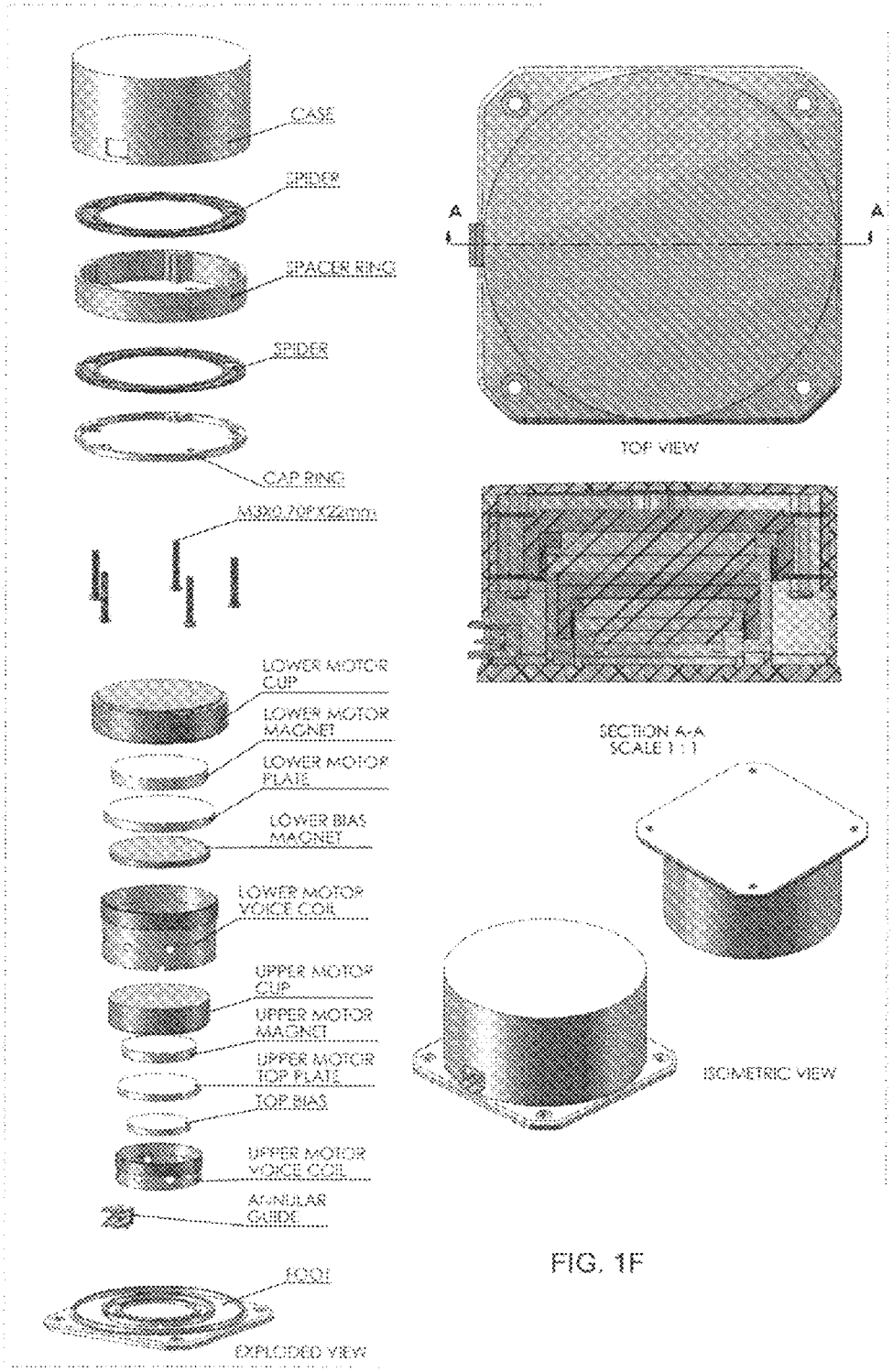
FIGS. 1F and 1G depict views of two embodiments of the present transducers.
Figure 1G:
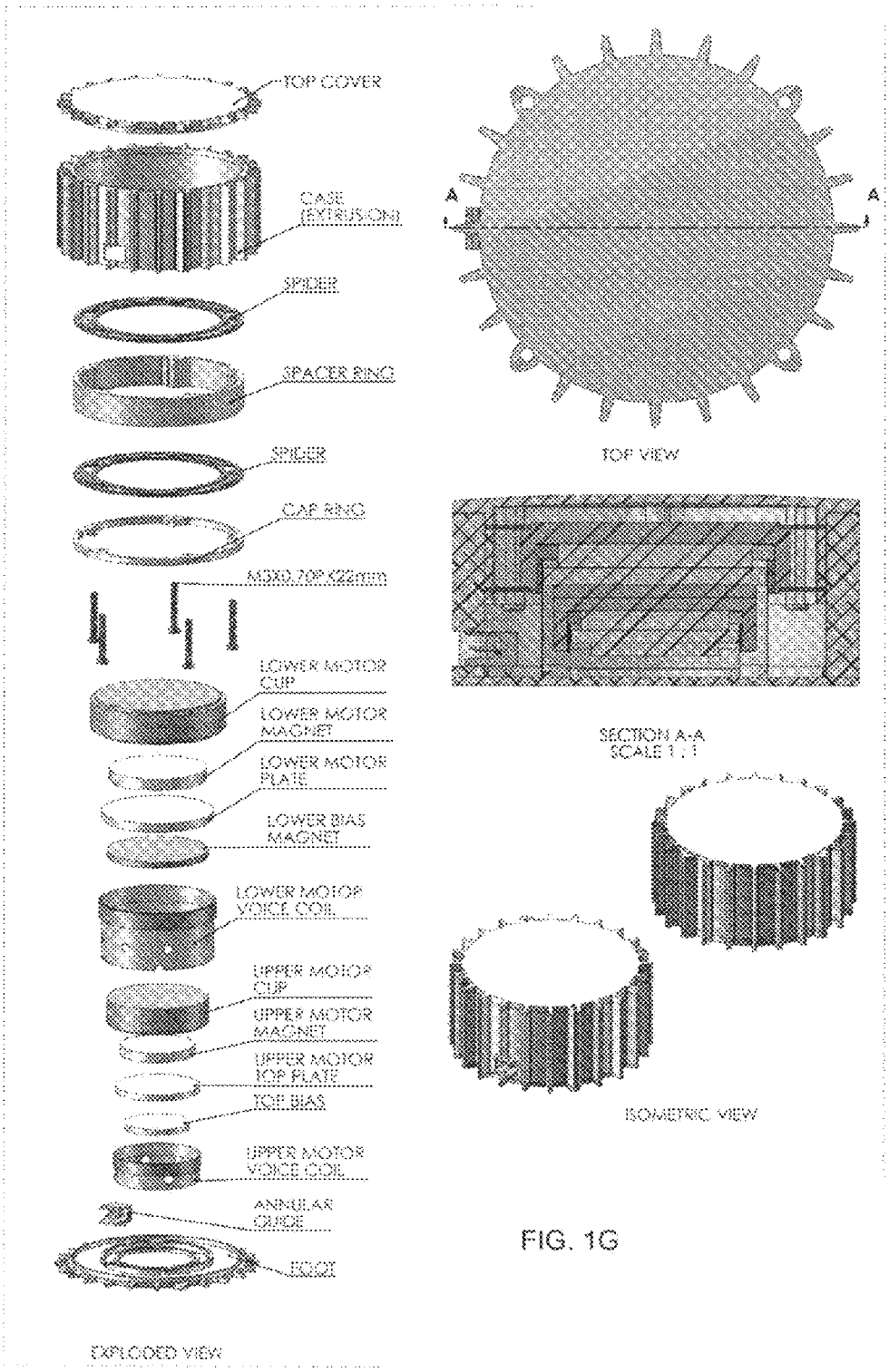

FIGS. 1F and 1G depict additional embodiments of the present transducers. FIGS. 1F and 1G depict versions of transducer 100 in exploded fashion (left side of figure), isometric perspective (right, lower portion of figure), and in cross section (right middle portion of figure). The cross sections are across axis A of the top view (top, right portion of each figure). As FIG. 1F shows, especially in the "TOP VIEW," the housing of the depicted embodiment is configured for attachment to another structure. In particular, the depicted embodiment of the present transducers is provided with four holes 158 in the housing (and, in particular, in the foot or base of the housing) through which fasteners (e.g., screws or the like) may be placed to attach the transducer to another structure, such as wall, ceiling or door. FIG. 1F also depicts fasteners 160, which may be used to couple one or more of suspension elements 139, spacer 133, and clamping flange 131 to top (or cover, or case) 142. FIG. 1G depicts another embodiment of the present transducers, setting forth using similar views to those in FIG. 1F. However, the housing of the embodiment in FIG. 1G has one or more fins 162, which may be characterized as heat conducting fins. Such fins may improve the power handling capacity of the transducer. Additionally, FIG. 1G, depicts an alternative embodiment of top 142. As shown in FIG. 1G, top 142 includes first portion 142*a* (which may be characterized as top, or cover, portion 142*a*) and second portion 142*b* (which may be characterized as side wall, or case, portion 142*b*). As depicted, first portion 142*a*, second portion 142*b*, and output base 140 (e.g., each element of the housing) each includes conducting fins 162. As shown, the conducting fins may be oriented lengthwise in the direction of the height of the housing, and may vary in length among the different housing elements (with the fins on the first portion and the output base being shorter than the fins on the second portion). In other embodiments, the fins may be oriented differently, such as circumferentially about the housing (perpendicular to the direction shown in FIG. 1G). In some embodiments, only a portion of the housing may include fins 162. The elements in FIGS. 1F and 1G are drawn to scale.

In some embodiments, transducer 100 may further include N assemblies (not shown), where N is greater than or equal to 3. The Nth assembly may include an Nth magnet operatively associated with an Nth coil. The Nth coil may be substantially coaxial with the (Nth−1) coil and may also be bounded by the perimeter of the (Nth−1) coil. The Nth assembly may also include an Nth flux focuser configured to shape the flux of the Nth magnet.

In some embodiments, the co-axial arrangement of the assemblies allows for the respective components of each assembly—and each coil within an assembly—to have a different perimeter (e.g., diameter) than similar respective components of the other assembly(ies). Each respective coil may be configured (e.g., optimized) to operate over a specific frequency band. This may be accomplished by configuring the smaller coils to operate over the higher frequencies and the larger coils to operate over the lower frequencies. The smallest perimeter (e.g., diameter) coil may have the lowest impedance rise with increasing frequency of the coils in the transducer, and thus may accept proportionally greater high frequency energy. Thus, by having a range of coil diameters instead of multiple coils of the same diameter that spaced apart from each other along the same axis, there may be a lower electrical input impedance over the operational frequency band of transducer 100.

Figure 2A:
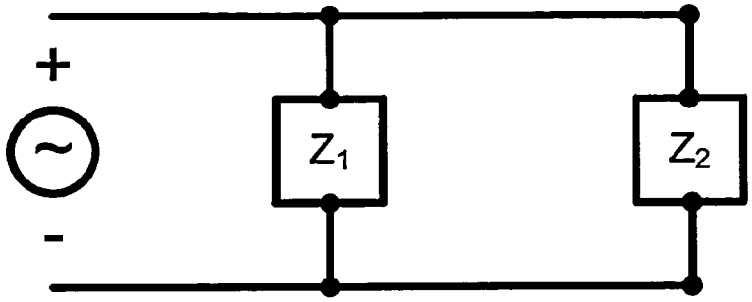
FIG. 2A is a schematic circuit for one embodiment of the present transducers.
Figure 2B:
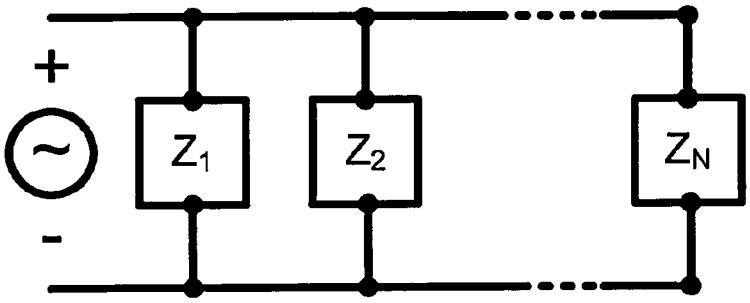
FIG. 2B is a schematic circuit for another embodiment of the present transducers.

As discussed earlier, in some embodiments, the coils within transducer 100 may be connecting in parallel. FIGS. 2A and 2B depict schematic diagrams of example resulting electric circuits. FIG. 2A depicts the electric circuit for the embodiment of transducer 100 in FIG. 1A. As shown, $Z_1$ represents the impedance of the first assembly and $Z_2$ represents the impedance of the second assembly. The impedance of the first assembly may be higher than the impedance of the second assembly. FIG. 2B depicts the electric circuit of an embodiment of the present transducers with N assemblies.

For example, with respect to the embodiment of the present transducers depicted in FIG. 1A, the second coil 120 has a smaller diameter than the first coil 108. As a result, second coil 120 may have a lower impedance rise with increasing frequency than first coil 108, and thus may accept proportionally higher frequency energy than first coil 108. First coil 108 and second coil 120 may be tailored to optimize the performance of transducer 100 over different frequency bands. For example, the coils may be configured such that, at lower frequencies, they work constructively, where the output of each is summed. Furthermore, the coils may be configured such that, at higher frequencies, the electrical input impedance of first coil 108 may be greater than at a lower frequency, while the electric input impedance of second coil 120 may be constant. As a result, the electrical power may be favorably shifted to the lower input impedance of second coil 120.

Example 1

Figure 3A:
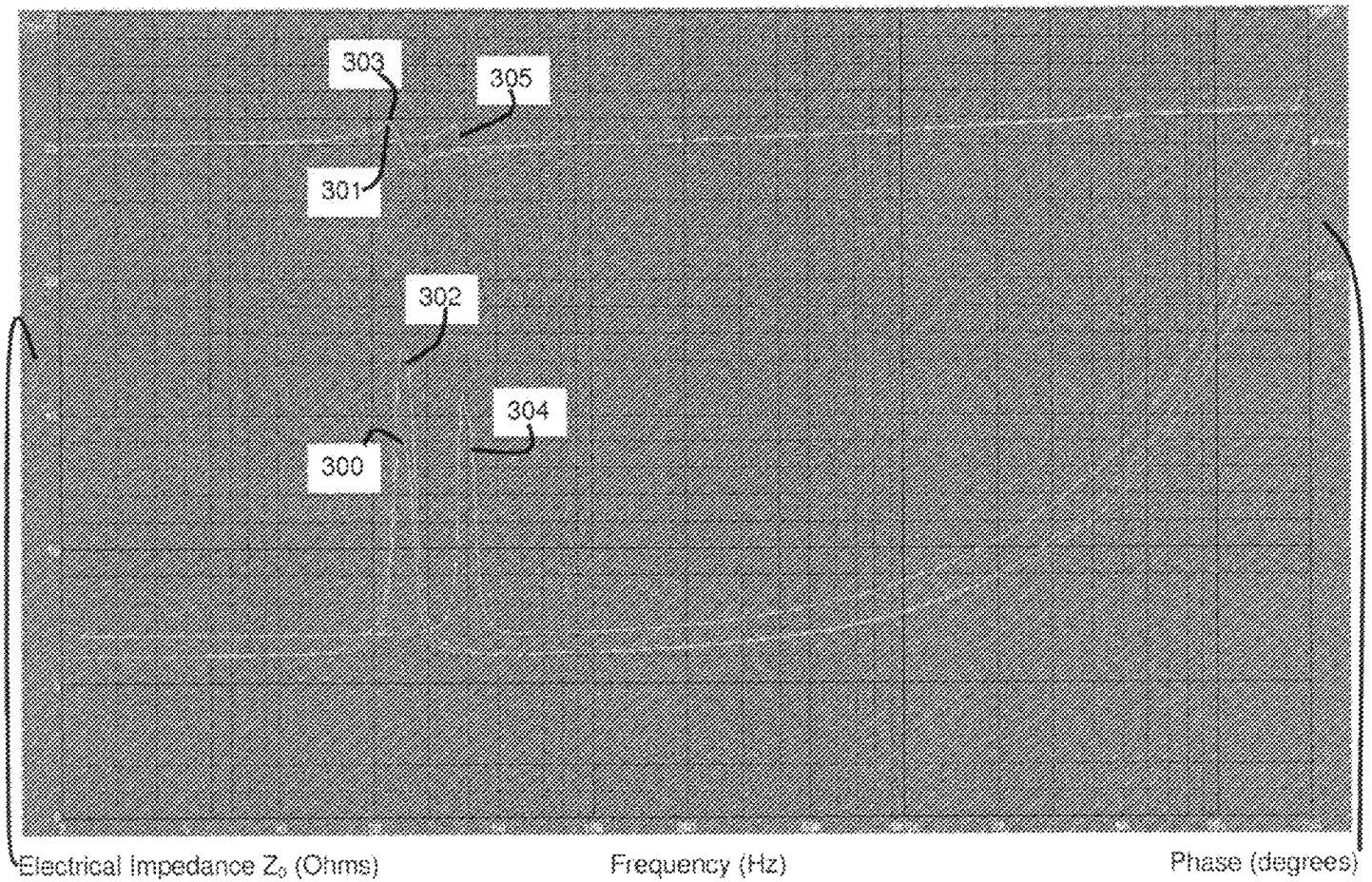
FIG. 3A is a graph of the electrical input impedance and phase response over the frequency range of operation of three embodiments of the present transducers.
Figure 3B:
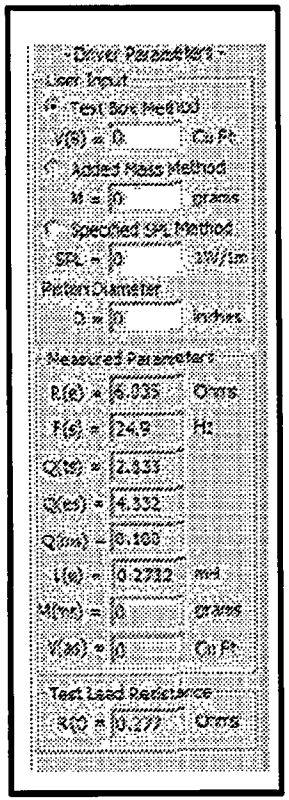
FIGS. 3B and 3C depict parameters associated with the testing that produced the responses shown in FIG. 3A.
Figure 3C:
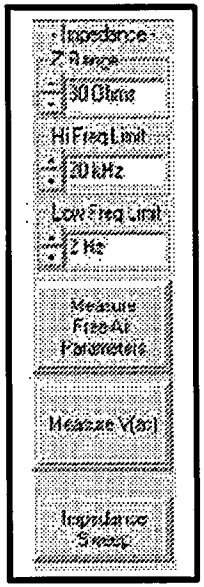

FIG. 3A depicts the electrical input impedance and phase responses of some embodiments of the present transducers over the frequency ranges of operation of those embodiments. FIGS. 3B and 3C depict certain parameters associated with the testing that resulted in the responses shown in FIG. 3A. The structure of transducer 100 was used. Plot 300 depicts the impedance versus frequency response of a version of transducer 100 with two 1.0 millimeter (mm)-thick polypropylene used for suspension elements 139 and 15 ohm at 0 Hz (DCR) coils used for first coil 108 and second coil 120. The resonant frequency of the suspension unit of that version is below the desired frequency of 40 Hz. Plot 301 depicts the phase response of the same version. The modest phase response showing modest phase change over the operating frequency of the tested transducer may enable high fidelity audio reproduction (meaning the transducer may be coupled to and cause a structure to produce high fidelity sound).

Plot 302 depicts the impedance versus frequency response of a version of transducer 100 with two 0.7 mm-thick glass fiber-reinforced epoxy (also known as glass-reinforced plastic, or glass fiber-reinforced plastic) used for suspension elements 139 and 15 ohm DCR coils used for first coil 108 and second coil 120. The resonant frequency of the suspension unit of that version is below the desired frequency of 40 Hz. Plot 303 depicts the phase response of the same version, and shows consistent input impedance to the electrical power supply.

Plot 304 depicts the impedance versus frequency response of a version of transducer 100 with two 1.0 mm-thick thick glass fiber-reinforced epoxy (also known as glass-reinforced plastic, or glass fiber-reinforced plastic) used for suspension elements 139 and 15 ohm DCR coils used for first coil 108 and second coil 120. The resonant frequency of the movable unit of this version is at the desired frequency of 40 Hz. Plot 305 depicts the phase response of the same version, and shows consistent input impedance to the electrical power supply.

Example 2

Figure 4:
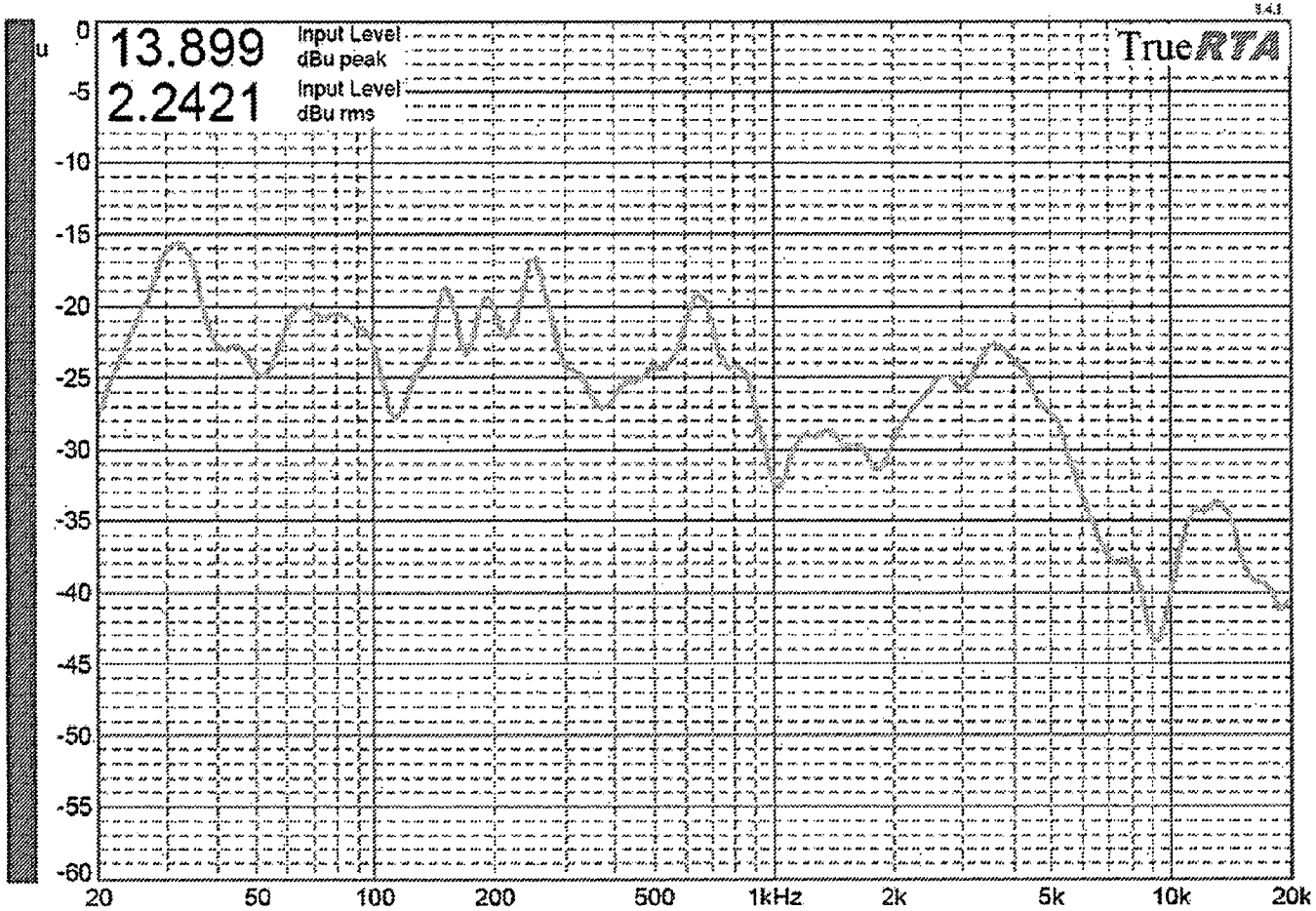
FIG. 4 is graph illustrating the frequency response of one embodiment of the present transducers.

FIG. 4 depicts the frequency response of an embodiment of transducer 100. In this embodiment, output base 140 of the external housing is coupled to a conventional one-half inch thick gypsum paneled wall with standard 16-inch on-center stud spacing. The wall was 12 feet wide and 8 feet tall. The plot in this figure depicts the frequency response of the transducer.

Example 3

Figure 5:
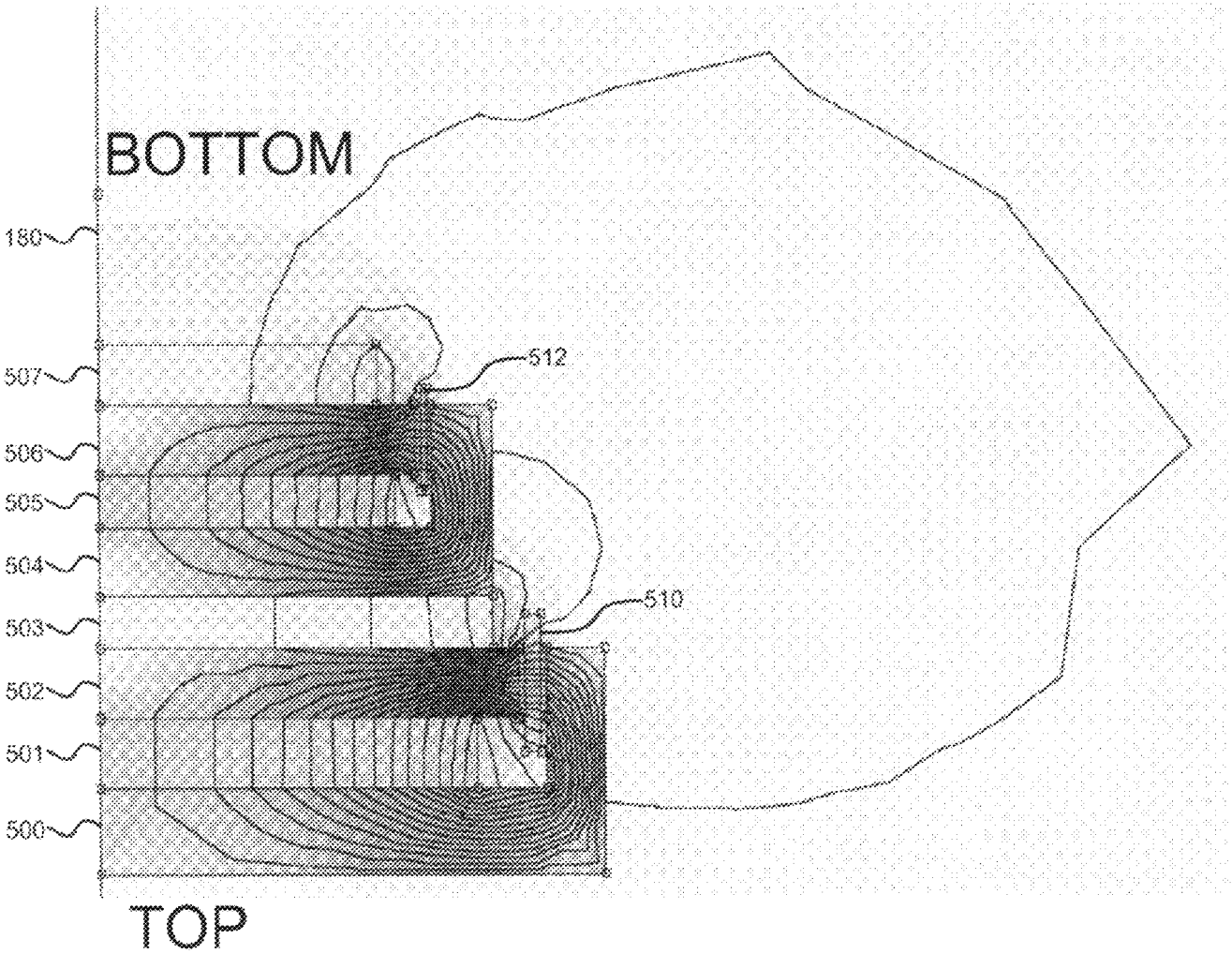
FIG. 5 is a finite element magnetic model analysis of one embodiment of the present transducers.

FIG. 5 depicts a finite element magnetic model analysis of one version of transducer 100. This axisymmetric model illustrates the DC magnetic flux resulting from corresponding assemblies. Axis 180 and the notations "TOP" and "BOTTOM" have been used to give the viewer reference information, and are used as they have been in FIG. 1A. The model illustrates the following magnetic path elements: first magnetic circuit return path 500, first magnet 501, first plate 502, first bucking magnet 503, second magnetic circuit return path 504, second magnet 505, second plate 506, and second bucking magnet 507. First coil 510 and second coil 512 are also depicted within the air-gaps.

As shown, the magnetic flux lines in first magnetic circuit return path 500 are approaching saturation. In this example, first magnetic circuit return path 500 has optimally provided a low-reluctance path for magnetic flux. Additionally, limited leakage flux lines are observed enabling this embodiment for use in magnetically sensitive applications.

The various illustrative embodiments of transducers described above and depicted in the figures are not intended to be limited to the particular forms disclosed. Rather, they include all modifications and alternatives falling within the scope of the claims. For example, while the external housing depicted in the figures is cylindrical, other shapes—including rectangular, octagonal, and domed—may be used in other embodiments. Furthermore, although the example of springs was provided for use as the disclosed suspension elements, other embodiments of those elements may take different forms, including rubber and elastic bands.

The claims are not intended to include, and should not be interpreted to include, means-plus- or step-plus-function limitations, unless such a limitation is explicitly recited in a given claim using the phrase(s) "means for" or "step for," respectively.

What is claimed is:

1. A transducer comprising:

a housing;

a first magnet positioned inside the housing;

a first coil positioned around at least a portion of the first magnet, the first coil being coupled to the housing, the first coil having a first outer perimeter;

a second magnet coupled to the first magnet; and a second coil positioned around at least a portion of the second magnet, the second coil being coupled to the housing in substantially coaxial alignment with the first coil and having a second outer perimeter that is less than the first outer perimeter;

where the first magnet is coupled to the housing and to the second magnet such that the first and second magnets are capable of moving together.

2. The transducer of claim 1, where the first magnet and the first coil comprise a first assembly, the second magnet and the second coil comprise a second assembly, and where the transducer further comprises N assemblies, where N is greater than or equal to 3 and each of the N assemblies includes a magnet and a coil.

3. The transducer of claim 2, where each assembly includes a coil former coupled to the coil of that assembly and to the housing.

4. The transducer of claim 1, where each of the N assemblies includes a flux focuser coupled to the magnet of that assembly.

5. The transducer of claim 4, where the flux focuser of an assembly comprises a plate attached to the magnet of that assembly.

6. The transducer of claim 5, where the flux focuser of an assembly further comprises a bucking magnet attached to the plate of that assembly.

7. A transducer comprising:

a housing;

a first magnet positioned inside the housing;

a first coil positioned around at least a portion of the first magnet, the first coil being coupled to the housing, the first coil having an outer perimeter;

a second magnet coupled to the first magnet; and a second coil positioned around at least a portion of the second magnet, the second coil being coupled to the housing in substantially coaxial alignment with the first coil and having a second outer perimeter that is less than the first outer perimeter;

where the first magnet is coupled to the housing and to the second magnet such that the first and second magnets are capable of moving relative to the first and second coils.

8. The transducer of claim 7, where the first magnet and the first coil comprise a first assembly, the second magnet and the second coil comprise a second assembly, and where the transducer further comprises N assemblies, where N is greater than or equal to 3 and each of the N assemblies includes a magnet and a coil.

9. The transducer of claim 8, where each of the N assemblies includes a coil former coupled to the coil of that assembly and to the housing.

10. The transducer of claim 7, where each of the N assemblies includes a flux focuser coupled to the magnet of that assembly.

11. The transducer of claim 10, where the flux focuser of an assembly comprises a plate attached to the magnet of that assembly.

12. The transducer of claim 11, where the flux focuser of an assembly further comprises a bucking magnet attached to the plate of that assembly.

* * * * *